US006619171B2

(12) United States Patent
Wade et al.

(10) Patent No.: US 6,619,171 B2
(45) Date of Patent: Sep. 16, 2003

(54) GUIDE BAR FOR TREE HARVESTING INCLUDING STUMP TREATMENT

(75) Inventors: Paul Edward Wade, Milan, TN (US); Gabriel Carro, Jackson, TN (US)

(73) Assignee: Blount, Inc., Portland, OR (US)

( * ) Notice: Subject to any disclaimer, the term of this patent is extended or adjusted under 35 U.S.C. 154(b) by 38 days.

(21) Appl. No.: 10/045,496

(22) Filed: Jan. 9, 2002

(65) Prior Publication Data

US 2003/0126965 A1 Jul. 10, 2003

(51) Int. Cl.[7] ..... B27B 17/02

(52) U.S. Cl. ..... 83/169; 29/505; 30/123.4; 144/34.1

(58) Field of Search ..... 144/34.1; 30/381, 30/382–387, 123.4; 47/1.5

(56) References Cited

U.S. PATENT DOCUMENTS

| | | | | |
|---|---|---|---|---|
| 3,797,754 A | * | 3/1974 | Spencer | 239/542 |
| 4,273,286 A | * | 6/1981 | Menzel | 239/272 |
| 4,747,613 A | * | 5/1988 | Brichoud et al. | 280/611 |
| 5,050,303 A | | 9/1991 | Sinclair | |
| 5,056,224 A | | 10/1991 | Seigneur | |
| 5,143,131 A | | 9/1992 | Seigneur | |
| 5,426,854 A | | 6/1995 | Leini | |
| 5,634,273 A | | 6/1997 | Michels | |
| 5,778,537 A | | 7/1998 | Leini | |
| 5,797,187 A | | 8/1998 | Leini | |
| 5,845,402 A | | 12/1998 | Leini | |
| 6,098,441 A | * | 8/2000 | Hada et al. | 72/370.27 |
| 6,397,452 B1 | * | 6/2002 | Frosberg et al. | 29/505 |

FOREIGN PATENT DOCUMENTS

| | | |
|---|---|---|
| CA | 295454 | 6/1929 |

* cited by examiner

*Primary Examiner*—Allan N. Shoap
*Assistant Examiner*—John Windmuller
(74) *Attorney, Agent, or Firm*—Robert L. Harrington; Schwabe Williamson & Wyatt

(57) ABSTRACT

A guide bar having fluid conveying channels at the opposed sides. The channel on one side provided by the manufacturer with holes or orifices for dispensing treatment fluid from the channels onto a stump being sawn. The other side provided with markings to guide the operator in making holes or orifices at the time the bar is to be inverted. The markings may be dimples to provide centering of a piercing tool. They may also be provided at the sides of the channel and different marking sets will provide for different sizes of trees being cut.

6 Claims, 2 Drawing Sheets

GUIDE BAR FOR TREE HARVESTING INCLUDING STUMP TREATMENT

FIELD OF THE INVENTION

This invention relates to guide bars for guiding saw chains in a chain saw and more particularly to the auxiliary use of the bars for dispensing treatment fluid to the stump and/or tree as the tree is being severed from the stump.

BACKGROUND OF THE INVENTION

It has been determined that a freshly cut tree stump is vulnerable to the growth of fungus that can be damaging to the future growth of adjacent trees and seedlings. To avoid such fungus growth, governments have regulated that freshly cut tree stumps are to be treated with an anti-fungus solution, e.g., urea.

It has been further determined that a preferred manner for applying the anti-fungus treatment, particularly when harvesting the trees using a tree harvester, is to equip the chain saw of the tree harvester with the means for dispensing the fluid onto the stump as the tree trunk is being cut from the stump.

Accordingly, chain saws have been developed whereby a fluid passage or channel is provided along the length of a guide bar of a chain saw, dispensing orifices are provided along the length of the channel and a source of treatment fluid is connected to the channel for injecting the fluid into the channel and through the orifice and onto a tree stump as the tree is being felled. Such a system is disclosed in U.S. application for patent Ser. No. 09/871,299 filed May 30, 2001 and which is commonly owned with the present invention.

The above explanation is somewhat misleading in the suggested simplicity of the system. It is desirable that the exposed sawn surface of the stump be evenly and completely treated with the fluid while avoiding excessive over spray, i.e., spray of the treatment fluid onto the vegetation and ground surrounding the tree stump. The chain saw of a tree harvester cuts through a tree by first centering the tree relative to the guide bar length and then pivoting the guide bar and cutting chain mounted thereon through the tree. If the bar is set up to cut large diameter trees, the dispensing orifices are extended substantially the full length of the bar and when cutting small diameter trees, there is excessive and undesired over spray. When set up to cut small diameter trees, as larger trees are encountered the spray will not be applied to the inner and outer reaches of the exposed surface, also undesired. Furthermore, due to the pivoting action of the chain saw, and thus the pivotal sweeping of the guide bar and saw chain through the tree (See FIG. 1), the inner length of the bar is exposed to a smaller portion of the stump surface than the outer length. This also contributes to uneven dispensing of the treatment fluid onto the stump.

From the above, it will be appreciated that the positioning of the orifices along the fluid channel is important. Manufacturers have addressed the problem of orifice size and location and have developed patterns of orifice sizes and spacing along the length of the bar. The patterns will not be further explained except to point out that the patterns may change between manufacturers of the guide bars and as between different sizes of trees being cut. Accordingly, it is presently considered desirable that the hole patterns be provided by the guide bar manufacturer to achieve optimum treatment of the stumps during felling.

The above is, however, incompatible with a problem that arises in providing invertible guide bars which are typical to the industry. As mounted on a chain saw, the leading edge of the bar is subjected to the cutting action and thus endures the greatest wearing. This is commonly countered by configuring the bar so that either edge can be mounted as the leading edge. This requires a symmetrical design of mounting slots and holes in the guide bar in general. Thus, when the initial leading edge of a bar becomes worn, the bar is simply inverted, the top becomes the bottom and the leading edge becomes the trailing edge. Yet the dispensing of the treatment fluid is confined to the bottom of the bar and it is not desirable to spray the freshly sawn surface of the severed tree. This, too, has been countered by placing a separate channel at each side of the guide bar. Only the channel that includes orifices open to the bottom side is connected to the source of the treatment fluid and the bar presumably now functions equally when inverted. This presumption is, however, incorrect as the unused orifices are subject to plugging as will be explained.

BRIEF DESCRIPTION OF THE INVENTION

Heretofore bars have been produced having channels at both sides and the desired pattern of orifices is provided for in each of the channels. The concept was that the bar could be inverted when the one side becomes worn and the bar could be placed back in service to effectively double its wear life. However, what would often happen is that the operator would continue the cutting operation for some period of time before it was discovered that there was no treatment fluid being dispensed on the stumps being cut.

What was happening was that the holes or orifices of the unused channel, not being cleared by the emission of fluid, were being plugged with dirt, tree pitch and the like as the bar was forced through the tree. By the time the bar was inverted, the orifices were totally plugged and not easily unplugged. The operator could poke a pointed tool into the holes to clear the holes but such merely pushed the debris into the channel to plug the channel.

The only solution appeared to be to not provide the orifices in the secondary side of the bar and allow the operator to pierce the channel when he inverted the bar to the second bar side. However, experience with this practice has shown that an acceptable distribution of the treatment of the stump is not achieved if hole location is left to the devices of the tree harvester operator.

The present invention solves this problem by predetermining the desired hole pattern for the "other" side, preferably providing a tool that would produce the desired hole size and then marking the "other" bar side and preferably the channel wall itself whereat the orifices are to be placed. Even further, the marking can consist of indentations in the channel wall at the desired positions and the operator need only to position the tool in each indentation and then tap the tool to puncture a hole into the channel.

The same concept can be used to expand the versatility of the bar. The bar can be provided with multiple patterns and color coded or otherwise coded to indicate hole size and spacing for different tree size ranges. These and other advantages and the structure for achieving such advantages will become more fully appreciated upon reference to the following detailed description having reference to the accompanying drawings.

DETAILED DESCRIPTION

Figure 1:
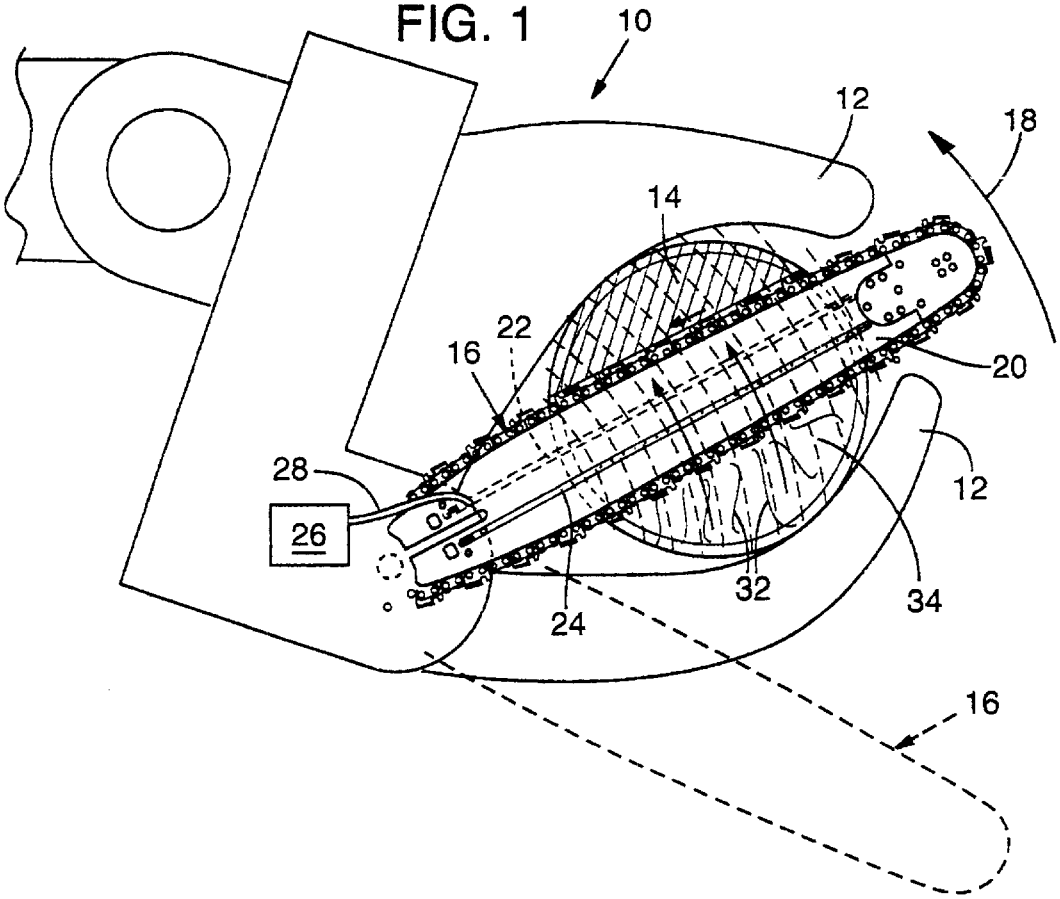
FIG. 1 illustrates a chain saw mounted on a tree harvester mast and in the process of cutting a tree as contemplated for the present invention.

FIG. 1 illustrates the mast 10 of a tree harvester which includes grapples 12 that clamp onto a tree 14. A chain saw 16 mounted to the mast is pivoted from the dash line position into and through the tree as indicated by arrow 18.

The guide bar 20 of the chain saw 16 is provided with a bottom channel 22 (shown in dash lines) and a top channel 24, the latter not in use during the illustrated cutting action. The bottom channel 22 is connected to a fluid treatment source 26 via connecting line 28 to provide fluid treatment, e.g., urea, to channel 22 and through orifices 30 (see FIG. 2). Accordingly, fluid 32 is supplied from source 26 to the bar and from the bar to the stump surface 34.

The present invention is directed to the channel 24 illustrated in FIG. 1 as being located at the top of the bar and not connected to the fluid source 26. It will be appreciated that the orifices 30 are provided in a desired pattern in channel 22 located on the bottom side as seen in FIG. 1, i.e., by the bar manufacturer, and it is this side that the tree harvester operator will be instructed to place in the down position when the bar is initially mounted to the chain saw 16.

Figure 2:
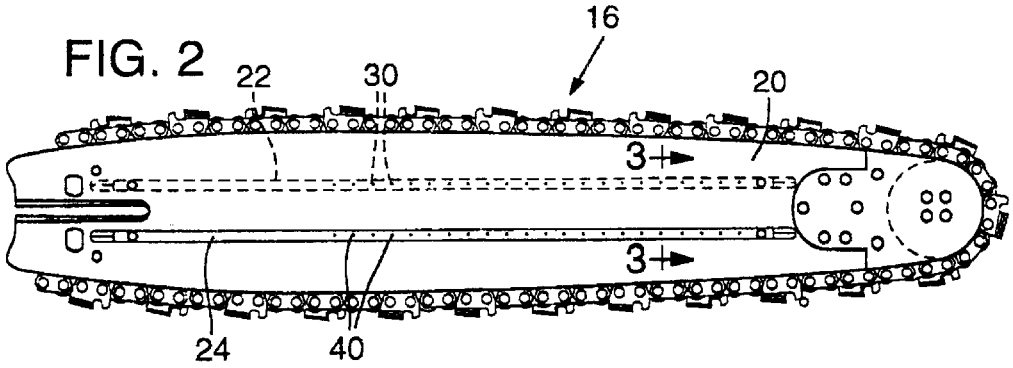
FIG. 2 is a top side view of the guide bar of FIG. 1 produced in accordance with the present invention.
Figure 3:
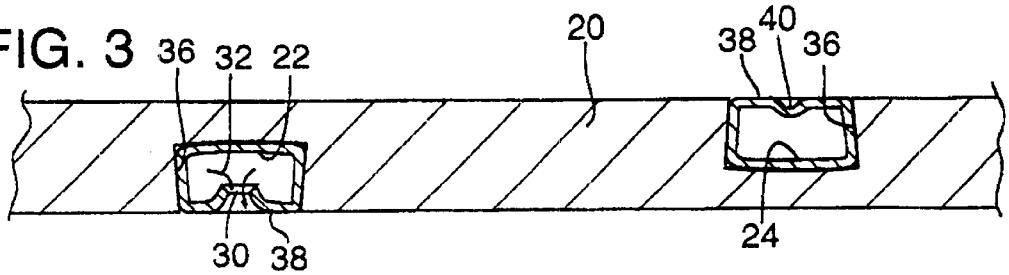
FIG. 3 is a sectional view as taken on view lines 3—3 of FIG. 2.

FIG. 3 illustrates a section of bar 20 as taken on view lines 3—3 of FIG. 2. FIG. 3 illustrates the channels 22, 24 as formed in the bar at the site of manufacture. The forming of the channels is, however, more fully explained in U.S. application Ser. No. 09/871,299 (previously referred to). In brief, the channels are tubes 38 that are inserted into grooves 36 that are machined or otherwise formed in the bar 20. The tubes are resistively forced into the grooves 36 and take the shape of the grooves, the walls of the grooves being flared to effectively grip and hold the tubes in place. Whereas a solid bar is indicated by bar 20, the reader will appreciate that a laminated guide bar can be provided with the channels as well.

Figure 4:
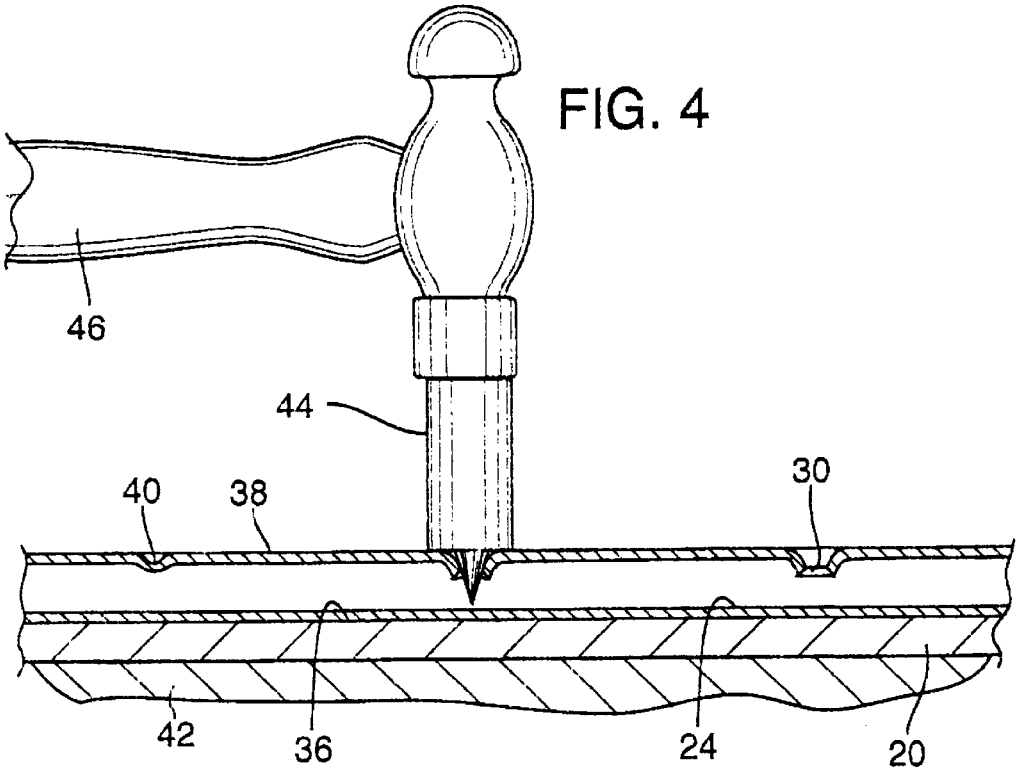
FIG. 4 is a schematic illustration of an operator producing holes in the channel in accordance with the invention.

As shown in FIG. 3, the tubes 38 of channel 22 are provided with orifice 30 whereas the tube 38 of channel 24 is not. In the embodiment of FIGS. 2 and 3, the desired location of the orifices in Channel 24 are indicated by indentations or dimples 40. Thus, when an operator of the tree harvester determines that the leading edge of the bar 20 is worn (as mounted in the position of FIG. 1), the bar is removed from the chain saw 16 and placed on a solid support 42 as illustrated in FIG. 4. A piercing tool 44 is positioned at the location of the indentations 40 and a driving tool 46 is wielded by the operator to pierce the channel at the indentations to form the desired orifices.

Preferably the tool is designed to produce the desired orifice size and accordingly is typically supplied by the bar manufacturer. The pattern of indentations is carefully determined and to generate the correct hole/orifice location, the operator need only carry the prescribed tool and a hammer, place the tool point sequentially in the indentations and strike the tool to pierce the tube of the channel and thereby achieve the desired hole size at the desired hole location. The process is repeated down the length of the channel until all the indentations are pierced. The bar is then mounted in an inverted relation and the connection line 28 connected now to the channel 24 to achieve the desired treatment of the tree trunks that will be cut with the bar in the inverted position.

Figure 5:
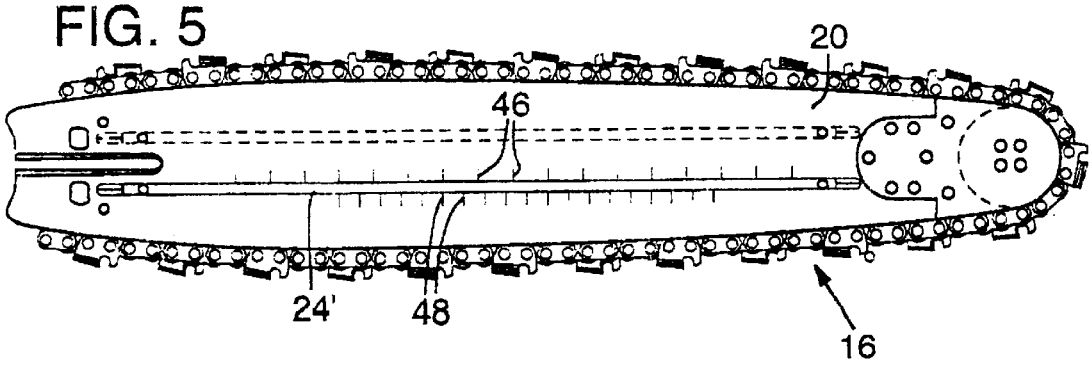
FIG. 5 is an alternative embodiment of the invention.

The reader will appreciate that the invention lends itself to a number of variations. FIG. 5 illustrates such a variation. FIG. 5 illustrates an unpierced channel 24' but rather than indentations, the hole locations are marked with color stripes 46 placed on the bar body and along side the channel 24'. The stripes may, however, be grooves or scratches or even dimples rather than colored stripes. Further, the stripes may be a variation of colors to indicate preferred hole sizes. It will be appreciated that a slightly larger size hole may be preferred at the distal end of the bar and, for example, the outer stripe designations 46 may be colored red, the mid stripes yellow and the inner stripes green, each color matched with a colored piercing tool to produce the desired hole sizes, the outer hole size larger than the mid hole size which is larger than the inner hole size.

FIG. 5 further provides stripes 48. As explained, the girth of a tree will determine a desired hole pattern. The combination of stripes 46 and 48 can be provided to indicate the desired hole location, e.g., stripes 46, indicating the hole locations of a stand of trees having a girth range of 15–30 inches in diameter, whereas stripes 48 indicate the hole locations, e.g., for a stand of trees in the girth range of 8–15 inches in diameter. Again the stripes may be color coded to indicate a preferred orifice size.

The above are but examples of the invention and those skilled in the art will appreciate the opportunity for numerous variations and modifications to the invention as disclosed. Accordingly, the invention is to be interpreted in accordance with the claims appended hereto noting the common dictionary meanings of the terms applied thereto to provide broad coverage for the invention.

The invention claimed is:

1. A guide bar for guiding a saw chain mounted to a chain saw comprising:

an elongated, flat plate configured to have opposed sides defining opposed guide edges, a nose portion and a tail end adapted to mount to a chain saw adjacent a drive sprocket whereby a saw chain mounted to the drive sprocket and guide bar will produce sliding engagement along the guide edges and around the nose portion;

a channel formed at each side of the plate and extended lengthwise down the plate, said plate structured to provide a connection for each channel at the tail end whereby a fluid source can be connected to a selected one of the channels;

at least one of the channels at one side devoid of orifices and markings provided at said one side establishing desired locations of orifices for treatment of a tree stump to be severed by the chain saw.

2. A guide bar as defined in claim 1 wherein the markings are indentations in the channel wall and further providing a centering dimple for the point of a piercing tool.

3. A guide bar as defined in claim 1 wherein the markings are grooves provided in the bar side adjacent the channel.

4. A guide bar as defined in claim 1 wherein the markings are color coded to indicate desired orifice locations.

5. A guide bar as defined in claim 1 wherein the orifice locations are color coded to indicate a desired orifice size.

6. A guide bar as defined in claim 1 wherein the bar is provided with multiple marking sets to indicate multiple sets of orifice locations, the multiple sets determining desired orifice patterns for different tree sizes.

* * * * *